US011306624B2

(12) United States Patent
Pipis, Jr. et al.

(10) Patent No.: US 11,306,624 B2
(45) Date of Patent: Apr. 19, 2022

(54) VALVE ACTUATION SYSTEM FOR ENGINE AND VALVE LIFTER AND ROCKER ARM FOR SAME

(71) Applicant: Caterpillar Inc., Peoria, IL (US)

(72) Inventors: John Stephen Pipis, Jr., Washington, IL (US); Selvaganpathi Ganesan, Chennai (IN)

(73) Assignee: Caterpillar Inc., Peoria, IL (US)

( * ) Notice: Subject to any disclaimer, the term of this patent is extended or adjusted under 35 U.S.C. 154(b) by 104 days.

(21) Appl. No.: 16/930,886

(22) Filed: Jul. 16, 2020

(65) Prior Publication Data

US 2022/0018266 A1 Jan. 20, 2022

(51) Int. Cl.

| | |
|---|---|
| ***F01L 1/14*** | (2006.01) |
| ***F01L 1/08*** | (2006.01) |
| ***F01L 1/46*** | (2006.01) |
| ***F01L 1/18*** | (2006.01) |
| ***F01M 9/10*** | (2006.01) |
| ***F02M 59/10*** | (2006.01) |
| ***F02M 59/02*** | (2006.01) |
| ***F01L 1/26*** | (2006.01) |
| ***F01L 1/20*** | (2006.01) |

(52) U.S. Cl.

CPC ..... *F01L 1/146* (2013.01); *F01L 1/08* (2013.01); *F01L 1/181* (2013.01); *F01L 1/20* (2013.01); *F01L 1/26* (2013.01); *F01L 1/46* (2013.01); *F01M 9/10* (2013.01); *F02M 59/027* (2013.01); *F02M 59/102* (2013.01); *F01L 2305/02* (2020.05)

(58) Field of Classification Search

CPC ... F01L 1/146; F01L 1/08; F01L 1/181; F01L 1/20; F01L 1/26; F01L 1/46; F01L 2305/02; F01M 9/10; F02M 59/027; F02M 59/102

See application file for complete search history.

(56) References Cited

U.S. PATENT DOCUMENTS

| | | | | |
|---|---|---|---|---|
| 4,007,716 | A | 2/1977 | Jones | |
| 4,655,177 | A * | 4/1987 | Wells | F01L 1/181 123/90.33 |
| 5,673,661 | A * | 10/1997 | Jesel | F01L 1/14 123/90.48 |
| 6,244,229 | B1 | 6/2001 | Nakano et al. | |
| 6,328,009 | B1 | 12/2001 | Brothers | |
| 2012/0073534 | A1 | 3/2012 | Tanaka et al. | |
| 2018/0080350 | A1* | 3/2018 | Nair | F01L 1/2411 |
| 2019/0360362 | A1* | 11/2019 | Cecil | F01L 1/181 |

* cited by examiner

*Primary Examiner* — Hung Q Nguyen

(74) *Attorney, Agent, or Firm* — Brannon Sowers & Cracraft

(57) ABSTRACT

A valve actuation system for an engine includes a rotatable camshaft, an injector actuation linkage, and a valve actuation linkage. The valve actuation linkage includes a valve lifter, a valve pushrod, and a rocker arm. At least one of a rocker arm center plane defined by the valve rocker arm or a lifter roller center plane defined by the valve lifter is spaced an offset distance from a pushrod axis, providing an increased contact width between an injector roller in the injector actuation linkage and one of a plurality of cam lobes of the camshaft. The valve lifter includes a fork defining a center plane spaced an offset distance from a center axis of the valve lifter. A rocker arm includes a screw bore offset relative to a rocker arm center plane.

20 Claims, 6 Drawing Sheets

VALVE ACTUATION SYSTEM FOR ENGINE AND VALVE LIFTER AND ROCKER ARM FOR SAME

TECHNICAL FIELD

The present disclosure relates generally to a valve actuation system for an engine, and more particularly to a valve actuation system structured for increased injector lifter roller contact width.

BACKGROUND

A wide variety of valve actuation systems are well known and widely used throughout the world in internal combustion engines. A typical engine configuration includes one or more intake valves and one or more exhaust valves each associated with a combustion cylinder in the engine. Over the course of an engine cycle a valve actuation system is used to open and close intake valves to allow a charge of fresh air, and sometimes fresh air mixed with fuel or other gases, to enter a cylinder. Following a combustion or expansion stroke, a valve actuation system is used to open exhaust valves to enable the combustion products to be expelled. Valve actuation systems can also include actuating mechanisms for fuel injectors in an engine. Similar configurations are commonly used for both fuel injector and engine valve actuating mechanisms, for example a lifter having a roller at one end that rotates in contact with lobes on a camshaft. As the cam lobes rotate they cause the lifters to move up and down, actuating a pushrod that is in turn coupled with a rocker arm.

In the case of intake valves and exhaust valves the rocker arm pivots to open the respective valve, in response to linear travel of the pushrod, and then reverse pivots to permit closing of the respective valve typically with cooperation of a return spring. In the case of actuating a fuel injector, an analogous configuration employing a pushrod that actuates a rocker arm is used in certain systems, with the injector rocker arm employed to exert a downward force on a tappet of the fuel injector, or an associated pump, that pressurizes fuel in the fuel injector for injection.

In recent years, engineers have been motivated to increase fuel injection pressures. Increased fuel injection pressure is associated with reductions in certain emissions, and can be exploited to various ends, such as for so-called "rate shaping." Relatively high fuel injection pressure can also enable a relatively greater amount of fuel to be burned in each engine cycle, ultimately allowing an engine to be constructed with a relatively greater power density, at least theoretically. The actuating systems associated with engine valves and fuel injectors can have various shortcomings, however. On the one hand, space constraints can limit the size, proportions, and type of components that can be employed. In a related aspect, increased injection pressures can subject actuation system components to greater stresses and accelerate certain wear phenomena. U.S. Pat. No. 5,673,661 to Jesel is directed to a valve lifter, purportedly constructed to increase available space for certain features of an internal combustion pushrod-type overhead valve engine. The Jesel design proposes pushrod seats offset in a desired direction. Offsetting of the various components away from adjacent intake ports apparently allows additional space for increasing size and area of the ports to increase breathing and power of the engine. While the design set forth in Jesel may have certain applications, there is always room for improvements and alternative strategies.

SUMMARY OF THE INVENTION

In one aspect, a valve actuation system for an engine includes a camshaft having a plurality of cam lobes and being rotatable about a camshaft axis. The system further includes an injector actuation linkage having an injector lifter with an injector roller in contact with a first one of the plurality of cam lobes. The system further includes a valve actuation linkage having a valve lifter defining a longitudinal center axis, a pushrod seat centered on the longitudinal center axis, and a lifter roller in contact with a second one of the plurality of cam lobes adjacent to the first one of the plurality of cam lobes. The valve actuation linkage further includes a valve rocker arm structured to couple with an engine valve, and a valve pushrod coupled between the valve lifter and the valve rocker arm and in contact with the pushrod seat. The valve rocker arm defines a pivot axis and a rocker arm center plane extending through a center point of the pivot axis. The lifter roller defines a rotation axis and a lifter roller center plane extending through a center point of the rotation axis. The valve pushrod defines a pushrod axis extending through the valve pushrod, the valve lifter, and the valve rocker arm. At least one of the rocker arm center plane or the lifter roller center plane is spaced an offset distance from the pushrod axis, within the respective rocker arm or valve lifter, in a direction parallel to the camshaft axis.

In another aspect, a valve lifter for a valve actuation system in an engine includes an elongate lifter body defining a longitudinal center axis and including an end section having a longitudinally extending pushrod bore formed therein, a pushrod seat centered on the longitudinal center axis within the longitudinally extending pushrod bore, a fork having an inboard leg and an outboard leg, and a middle section transitioning between the end section and the fork. The inboard leg is spaced from the outboard leg to form a roller pocket, and the inboard leg and the outboard leg forming coaxial pin bores structured to receive a roller pin for supporting a roller in the roller pocket. A center plane is defined between the inboard leg and the outboard leg and is spaced an offset distance from the longitudinal center axis.

In still another aspect, a rocker arm for a valve actuation system in an engine includes a rocker arm body having a rod end, a valve end, a center section, and each of a first lateral side and a second lateral side extending between the rod end and the valve end. The rocker arm body further having a pivot pin bore formed in the center section and extending horizontally through the rocker arm body between the first lateral side and the second lateral side and defining a pivot axis. A rocker arm center plane extends through a center point of the pivot axis and is located equidistant between the first lateral side and the second lateral side. The valve end further has a first bore formed therein and located symmetrically between the first lateral side and the second lateral side, such that the first bore is bisected by the rocker arm center plane. The rod end further has a second bore formed therein and located asymmetrically between the first lateral side and the second lateral such, such that the second bore is offset relative to the rocker arm center plane and located relatively closer to the first lateral side than to the second lateral side.

DETAILED DESCRIPTION

Figure 1:
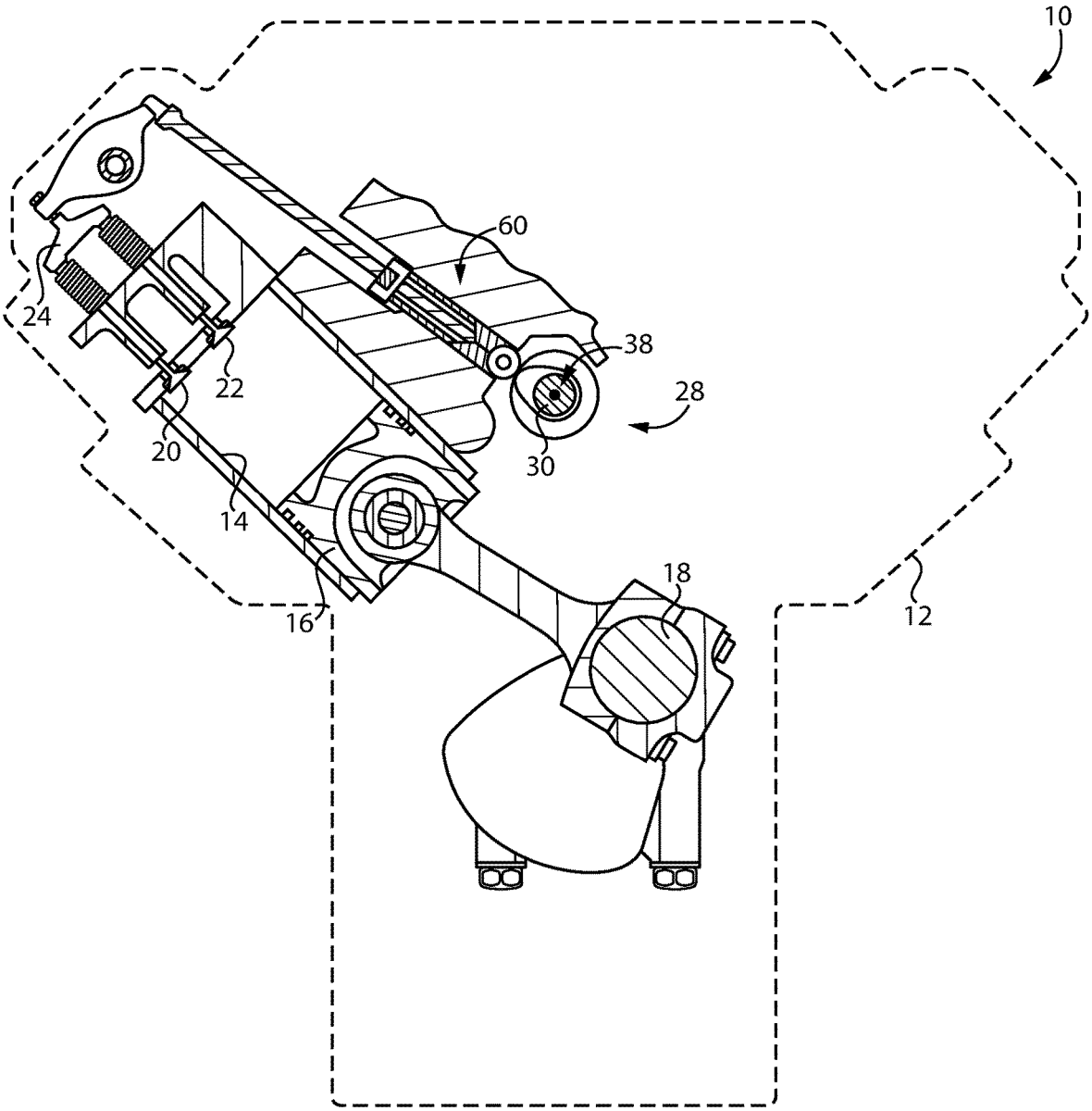
FIG. 1 is a partially sectioned diagrammatic view of an internal combustion engine system, according to one embodiment.

Referring to FIG. 1, there is shown a valve actuation system 28 in an internal combustion engine 10. Internal combustion engine 10 includes an engine housing 12 having a cylinder 14 formed therein, and a piston 16 movable in cylinder 14. Piston 16 is coupled with a crankshaft 18 in a generally conventional manner. Engine 10 also includes a plurality of engine valves 20 and 22 each associated with cylinder 14 and including two intake valves, two exhaust valves, or an intake valve and an exhaust valve. In the illustrated embodiment engine valves 20 and 22 are of the same type and are coupled together by way of a valve bridge 24. Valve actuation system 28 (hereinafter "system 28") is structured to open and close engine valves 20 and 22 together in response to rotation of a camshaft 30 about a camshaft axis 38. Cylinder 14 may be one of any number of cylinders arranged in engine 10 in any suitable configuration such as a V-pattern, an inline pattern, or still another. Engine 10 can include a direct-injected compression-ignition engine structured to operate on a liquid fuel such as a diesel distillate fuel. The present disclosure is not thereby limited, however, and engine 10 could be port-injected, supplied with a mixture of premixed fuel and air introduced upstream of engine 10, could be spark-ignited, or could have a variety of features and functionality different from those specifically discussed herein. As will be further apparent from the following description, valve actuation system 28 may be structured to provide for a relatively increased power density of engine 10.

Figure 2:
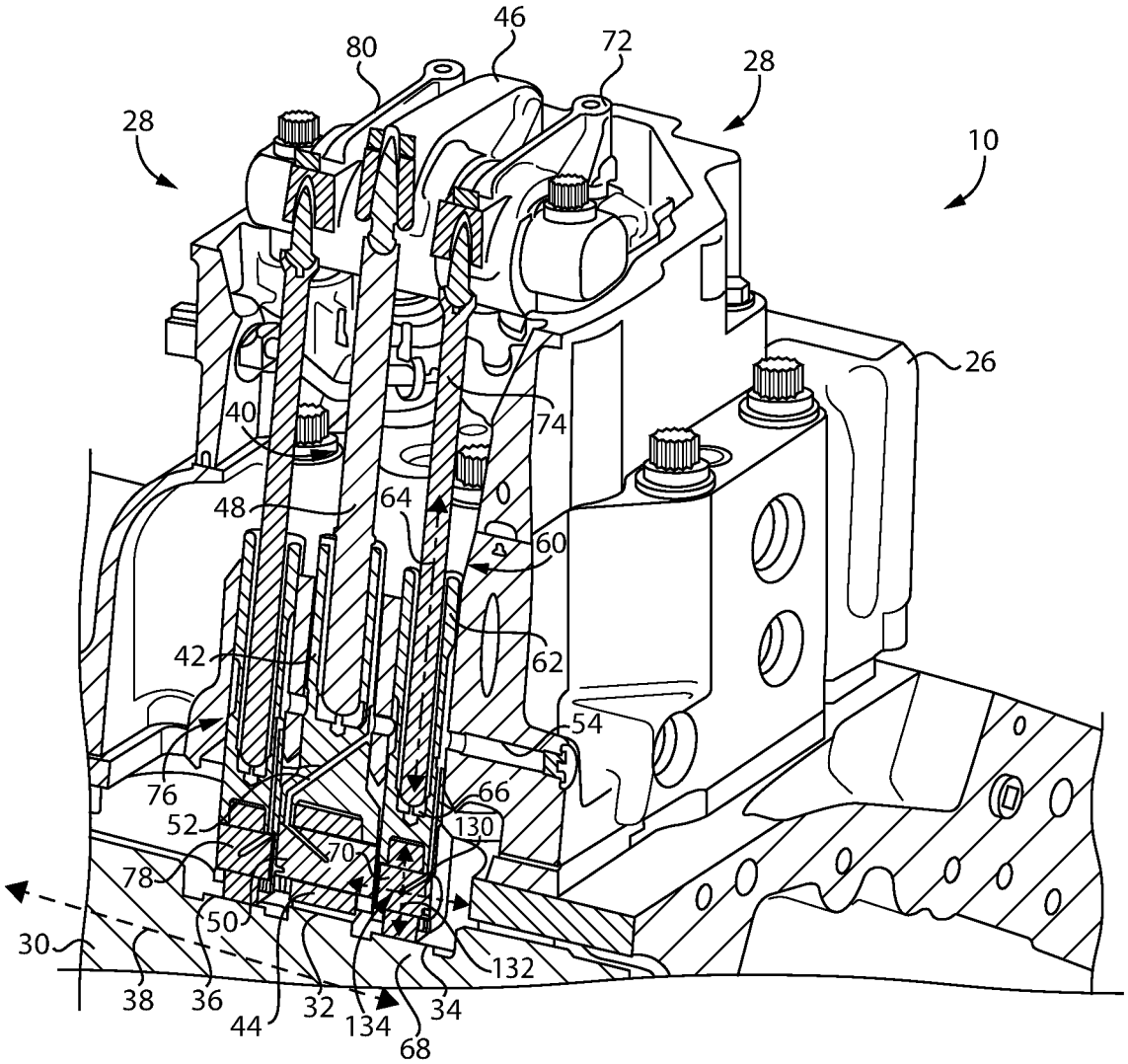
FIG. 2 is a sectioned diagrammatic view, in perspective, of a valve actuation system in an engine, according to one embodiment.

Referring also now to FIG. 2, there are shown additional features of valve actuation system 28 mounted in or on an engine head 26 of engine 10. Camshaft 30 includes a plurality of cam lobes 32, 34, and 36, rotatable with camshaft 30 about a camshaft axis 38. Camshaft 30 may be rotated by way of an engine geartrain coupled with camshaft 18. Valve actuation system 28 includes an injector actuation linkage 40 structured to operate a fuel injector, such as by moving a tappet in the fuel injector to pressurize a fuel in response to rotation of camshaft 30. Injector actuation linkage 40 includes an injector lifter 42 having an injector roller 44 in contact with a first one 32 of the plurality of cam lobes. Injector actuation linkage 40 further includes an injector rocker arm 46, and an injector pushrod 48 coupled between injector lifter 42 and injector rocker arm 46. An injector roller pin 50 is supported in injector lifter 42 and positions injector roller 44 for rotation. An oil passage 52 extends through injector lifter 42 to provide lubricating oil to contacting surfaces of injector roller 44, injector roller pin 50, and cam lobe 32. An oil supply passage 54 is formed in engine head 26 and supplies oil to injector actuation linkage 40 and the valve actuation linkages further discussed herein.

System 28 further includes a first valve actuation linkage 60 having a valve lifter 62 defining a longitudinal center axis 64, a pushrod seat 66 centered on longitudinal center axis 64, and a lifter roller 68. A pin 70 is positioned and supported in valve lifter 62, and a lifter roller 68 is rotatable about pin 70 in contact with a second one 34 of the plurality of cam lobes. Cam lobe 34 is adjacent to the first one 32 of the plurality of cam lobes. Valve actuation linkage 60 further includes a valve rocker arm 72 structured to couple with an engine valve, including one or both of engine valves 20 and 22. Valve actuation linkage 40 also includes a valve pushrod 74 coupled between valve lifter 62 and valve rocker arm 72 and in contact with pushrod seat 66.

Valve actuation system 28 further includes a second valve actuation linkage 76 that is a mirror image of first valve actuation linkage 60 and positioned opposite to first valve actuation linkage 60 relative to injector actuation linkage 40. Second valve actuation linkage 76 includes a lifter roller 78 in contact with a third one 36 of the plurality of cam lobes, and a valve rocker arm 80. The operation of second valve actuation linkage 76 may be substantially identical to the operation of valve actuation linkage 60 except that one of the respective linkages can operate intake valves and the other can operate exhaust valves. The description of the respective linkages as being mirror images refers to an arrangement and construction of the respective components, including in the illustrated embodiment the construction of rocker arms 72 and 80. Relative adjustments amongst the components of the respective linkages based upon operating differences between intake valves versus exhaust valves, such as to compensate for difference tolerance stack-ups, or to obtain different valve opening distances or the like, could be used.

Figure 3:
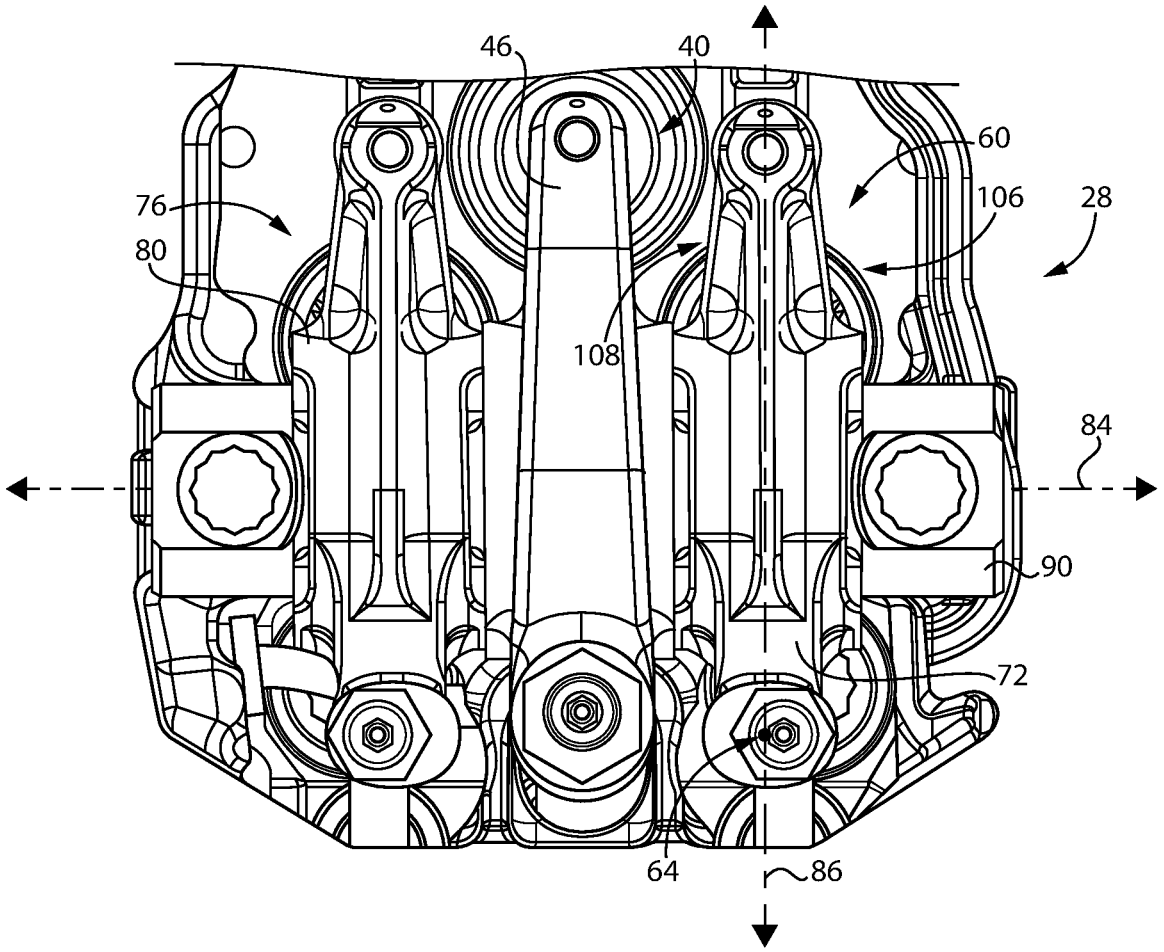
FIG. 3 is a top elevational view of a valve actuation system, according to one embodiment.

Referring also to FIG. 3, it will be noted that valve actuation linkages 60 and 76 are positioned just adjacent to injector actuation linkage 40. As further discussed herein, in certain earlier designs a desire for increased fuel injection pressure, such as by using steeper and/or larger cam lobes, was associated with increased wear on injector actuation linkages or performance degradation. The present disclosure provides solutions for increasing a contact area between injector roller 44 and cam lobe 32 relative to such earlier systems without unduly affecting packaging or other considerations. Together, or independently, these solutions enable shifting the locations of rollers 68 and 78 outwardly relative to cam lobe 32 to provide a relatively larger contact width between injector roller 44 and cam lobe 32. In one embodiment, the described shifting of locations is made possible at least in part by features of the valve rocker arms.

Figure 4:
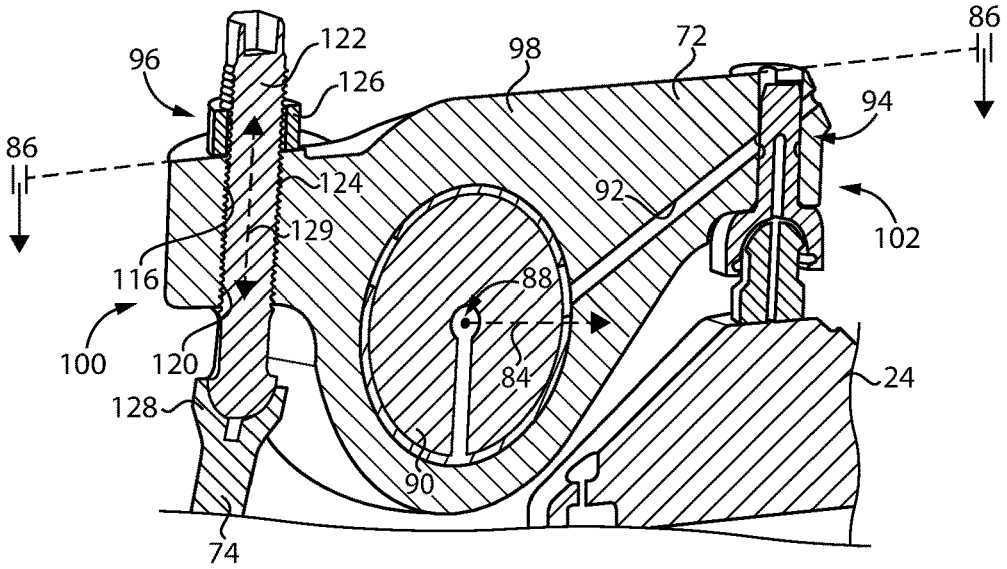
FIG. 4 is a sectioned diagrammatic view of a portion of the valve actuation system of FIGS. 2 and 3.
Figure 5:
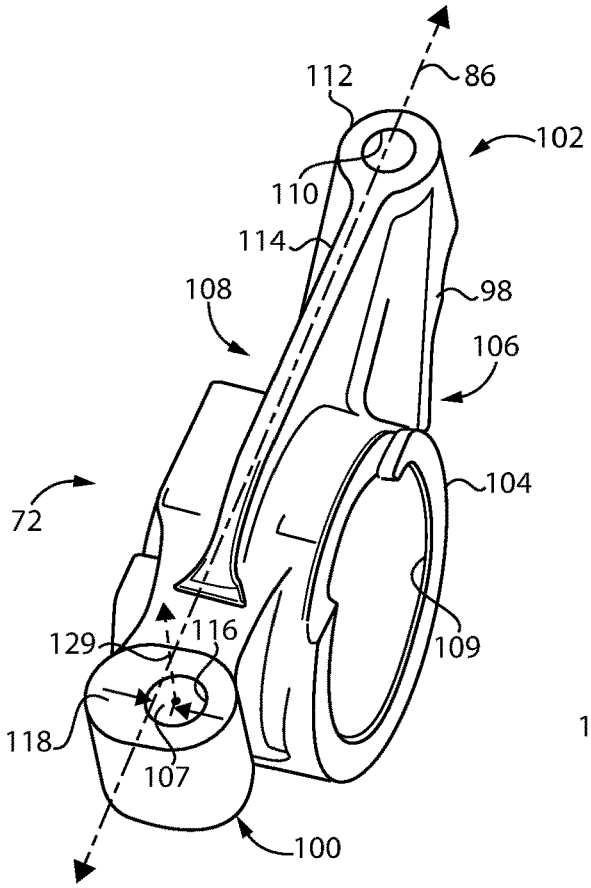
FIG. 5 is a diagrammatic view of a rocker arm, according to one embodiment.

To this end, referring also now to FIGS. 4 and 5, valve rocker arm 72 defines a pivot axis 84 and a rocker arm center plane 86 extending between a center point 88 of pivot axis 84. A rocker pin 90 is also shown in the drawings and extends through each of rocker arm 72, rocker arm 80, and rocker arm 36, in the illustrated embodiment. Rocker arm 72 includes a rocker arm body 98 having a rod end 100, a valve end 102, a center section 104, and each of a first lateral side 106 and a second lateral side 108 extending between rod end 100 and valve end 102. Rocker arm body 98 further has a pivot pin bore 109 formed in center section 104, receiving rocker pin 90, and extending horizontally through rocker arm body 98 between first lateral side 106 and second lateral side 108. Rocker arm center plane 86 can be seen to longitudinally bisect rocker arm body 98 between rod end 100 and valve end 102. Valve end 102, structured to couple with an engine valve, further has a first bore 110 formed therein and located symmetrically between first lateral side 106 and second lateral side 108. In the illustrated embodiment first bore 110 is formed in an enlarged head 112 of valve end 102. Rod end 100 further includes a second bore 116 formed therein and located asymmetrically between first lateral side 106 and second lateral side 108, such that second bore 116 is offset relative to rocker arm center plane 86 and located relatively closer to first lateral side 106 than to second lateral side 108. Also, in the illustrated embodiment second bore 116 is formed in an enlarged head 118 of rod end 100.

As can also be seen from FIG. 4, rocker arm 72 can be equipped with apparatus for coupling with valve bridge 24, including a socket assembly 94, and could be coupled with one or more engine valves in any suitable manner. An oil passage 92 extends through rocker arm body 98, and can receive a feed of oil such as through pin 90. Also shown in FIG. 4 is apparatus for coupling rocker arm 72 with pushrod 74, including a screw assembly 96. Second bore 116 may include a screw bore, with internal threads 120 structured to mate with external threads 124 upon an adjustment screw 122. A socket 128 or the like, of or coupled with pushrod 74, can engage with adjustment screw 122. Adjustment screw 122 can be rotated to vary the connection between rocker arm 72 and pushrod 74, and is secured with a nut 126.

It will be recalled that the construction of rocker arms can provide the desired shift or offset to provide an optimized contact width between injector roller 44 and cam lobe 32. Locating second bore 116 asymmetrically between first lateral side 106 and second lateral side 108 provides an offset in location of second bore 116 laterally. Second bore 116 defines a center axis 129 that may be spaced an offset distance 107 from rocker arm center plane 86.

Figure 6:
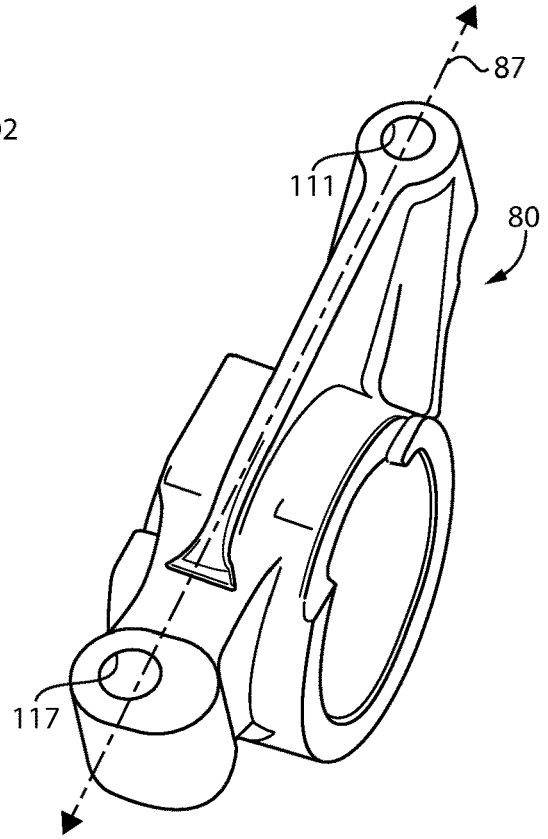
FIG. 6 is a diagrammatic view of a rocker arm, according to one embodiment.

Turning now to FIG. 6, there is shown rocker arm 80. It will be recalled that components of the respective valve actuation linkages may be mirror images of one another, as is the case with rocker arms 72 and 80 based on locations of the respective screw bores. Rocker arm 80 defines a rocker arm center plane 87, and includes a first bore 111 and a second bore 117 (a screw bore) analogous to first bore 110 and second bore 116 except with regard to the direction that second bore 117 is offset relative to rocker arm center plane 87. As can be seen by comparing FIG. 5 and FIG. 6 rocker arm 72 offsets second bore 116 to the right of rocker arm center plane 86, whereas in rocker arm 80 second bore 117 is offset to the left of rocker arm center plane 87. Each of bores 116 and 117 is intersected by the respective center plane in the illustrated embodiments, however, the present disclosure is not thereby limited and rocker arms could be constructed where the second bores or screw bores are located fully to one side or the other of the respective rocker arm center plane.

Returning to FIG. 2, there it can be seen that lifter roller 68 defines a rotation axis 130 and a lifter roller center plane 132 extending through a center point 134 of rotation axis 130. Pushrod 74 defines a pushrod axis, which in the illustrated case is colinear with longitudinal center axis 64 and commonly labeled, with axis 64 extending through valve pushrod 74, valve lifter 62, and valve rocker arm 72. It will be recalled that in the embodiment of FIG. 2 a desired offset is obtained based on the configurations of rocker arms 72 and 80. Additionally or alternatively, and as further discussed below, an offset can be obtained based on the configuration of valve lifters. Accordingly, the present disclosure contemplates at least one of rocker arm center plane 86 or lifter roller center plane 132 being spaced an offset distance from axis 64, within the respective rocker arm 72 or valve lifter 62, and in a direction parallel to camshaft axis 38. Also in the embodiment of FIG. 2, rocker arm center plane 86 is spaced an offset distance from axis 64 in an inboard direction. In the case of an embodiment where an offset is obtained based on the configuration of valve lifters a lifter roller center plane is spaced an offset distance from a valve lifter longitudinal center axis in an outboard direction. "Outboard" means away from injector actuation linkage 40, in a direction parallel to the camshaft axis 38. "Inboard" means an opposite direction.

Figure 7:
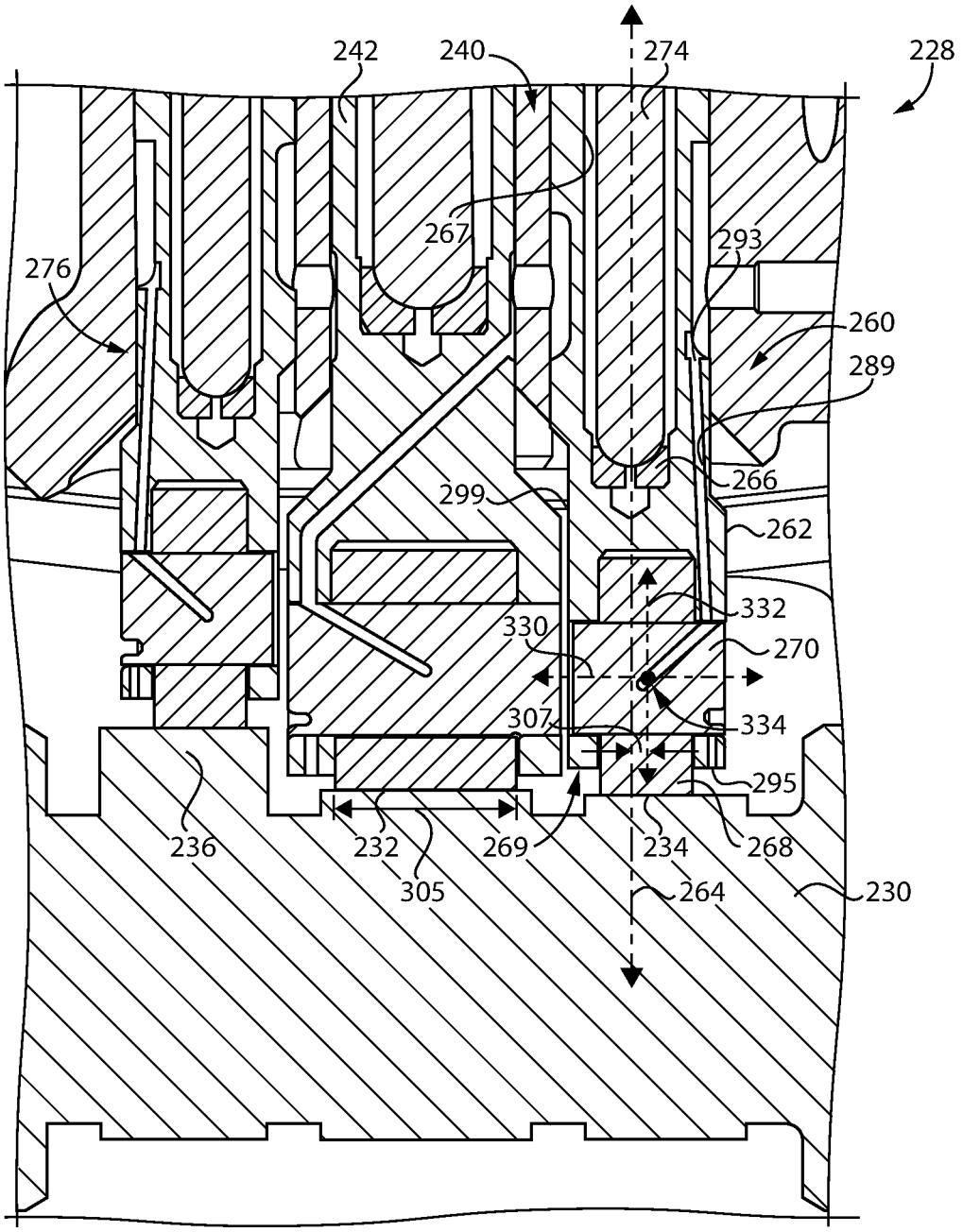
FIG. 7 is a sectioned diagrammatic view of a portion of a valve actuation system for an engine, according to one embodiment.
Figure 8:
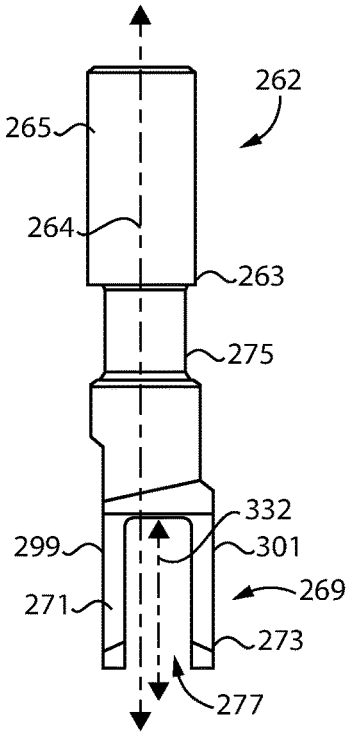
FIG. 8 is a side view of a valve lifter, according to one embodiment.
Figure 9:
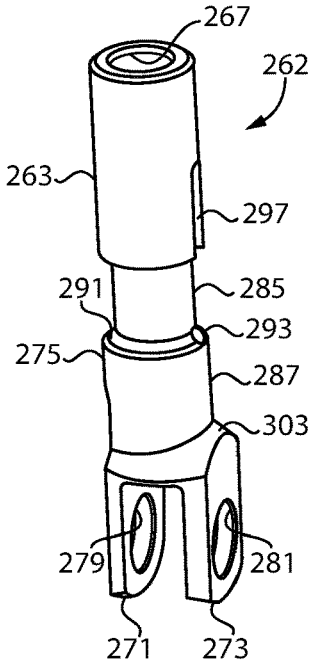
FIG. 9 is a perspective view of a valve lifter, according to one embodiment.
Figure 10:
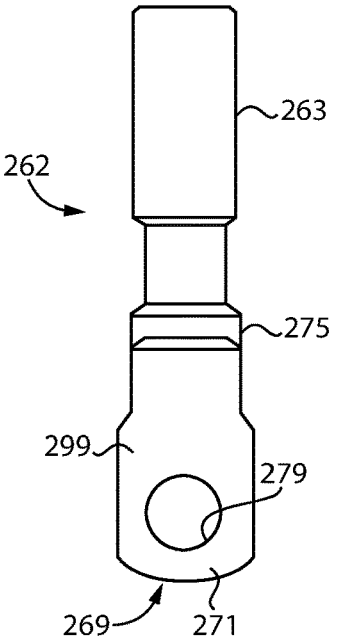
FIG. 10 is another side view of a valve lifter, rotated 45° relative to FIG. 8.

Referring now to FIG. 7, there is shown a valve actuation system 228 including an injector actuation linkage 240, a first valve actuation linkage 260, and a second valve actuation linkage 276. Valve actuation linkage 260 and valve actuation linkage 276 may be mirror images of one another, and may be structured to actuate one or more exhaust valves each, or one or more intake valves each. Injector actuation linkage 240 may be substantially identical to injector actuation linkage 40 discussed above, however, in the case of valve actuation system 228 instead of an offset to provide a relatively increased injector roller width being based on rocker arm configuration, an offset is based on valve lifter configuration. As can be seen in FIG. 7 an injector roller width is shown at 305, and an offset distance is shown at 307. Injector roller width 305 may exceed offset distance 307 by a factor greater than 10. A similar roller width and offset distance provided by the rocker arm configuration in the prior embodiment of valve actuation system 28 may be provided.

Valve actuation linkage 260 includes a valve lifter 262 defining a longitudinal center axis 264. Valve lifter 262 includes a pushrod seat 266 centered on axis 64. A lifter roller is shown at 268 and positioned upon a pin 270, and a pushrod 274 is coupled with valve lifter 262 to in turn actuate a rocker arm (not shown), generally analogous to the operation described in connection with the preceding embodiment of engine valve actuation system 28. Pushrod 274 defines a pushrod axis colinear with axis 264 and thus commonly labeled. Referring also now to FIGS. 8-11, valve lifter 262 includes an elongate lifter body 263 defining axis 264 and having an end section 265 with a longitudinally extending pushrod bore 267 formed therein, and with a pushrod seat 266 centered on axis 264 and received in pushrod bore 267. Elongate lifter body 263 further includes a fork 269 having an inboard leg 271 and an outboard leg 273, and a middle section 275 transitioning between end section 265 and fork 269. Inboard leg 271 is spaced from outboard leg 273 to form a roller pocket 277. Inboard leg 271 and outboard leg 273 form coaxial pin bores 279 and 281, respectively, and receive roller pin 270. Roller pin 270 supports lifter roller 268, rotatable about a rotation axis 330. A center plane 332 is defined between inboard leg 271 and outboard leg 273 and is spaced an offset distance 307 from longitudinal center axis 264.

Figure 11:
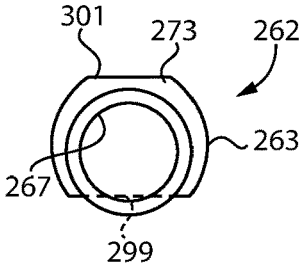
FIG. 11 is an end view of the valve lifter of FIGS. 8-10.

As can also be seen from FIGS. 8-11, middle section 275 may include a necked-down section 285 adjacent to end section 265. Middle section 275 may also include a transition section 287 adjacent to fork 269. As best depicted in FIG. 11, end section 265 and transition section 287 may each be substantially cylindrical, or include substantially cylindrical features extending circumferentially around axis 264, such that end section 265 and transition section 287 define a common cylinder centered on axis 264. Outboard leg 273 is located at least partially outside of the common cylinder. Valve lifter 262 may further include an oil passage 289 as best shown in FIG. 7 that extends through lifter body 263 from middle section 275 to fork 269. In the illustrated embodiment, a step 291 is formed between necked-down section 285 and transition section 287, and oil passage 289 extends from an inlet port 293 formed in step 291 and an outlet port 295 formed in fork 269, and in particular in outboard leg 273. When positioned for service in an engine, necked-down portion 285 receives and conveys a flow of oil around valve lifter 262, and supplies the same to inlet port 293. The oil is in turn conveyed through oil passage 289 to provide lubrication to pin 270 and roller 268, and to the associated cam lobe 234.

As also shown in FIGS. 8-11, lifter body 263 may further include an inboard side surface 299 and an outboard side surface 301. Inboard side surface 289 may be formed in part upon inboard leg 271 and in part upon transition section 287. Inboard side surface 299 may be planar and stepped-in relative to middle section 275. Outboard side surface 301 may be planar and stepped-out relative to middle section 275. A curved and sloped surface 303 transitions between middle section 285 and inboard leg 271 and outboard leg 273. As shown in FIG. 7, a center point 334 of rotation axis 330 is shown spaced offset distance 307 in an outboard direction, from center plane 264. It can also be seen from FIG. 7 that inboard side surface 299 is in spaced facing relation to injector lifter 242. By positioning fork 269 in a manner that is offset from axis 262 injector lifter 242 can be positioned slightly within a spatial envelope defined by valve lifter 262. Accordingly, the embodiment set forth in FIGS. 7-11 can be understood as a solution to provide an increased injector roller-cam lobe contact width based on the configuration of valve lifters, whereas in the preceding embodiment of system 28 the offset is provided based on the configuration of rocker arms. In either case, an offset distance, shown at 307 in FIG. 7 might be between 2.5 millimeters and 3.5 millimeters, more particularly between 2.8 and 3.0 millimeters. Summed together, offsets provided on outboard sides of an injector lifter in any of the embodiments contemplated herein can enable an increase in roller width 305 that is between 5 millimeters and 7 millimeters, and more particularly between 5.7 and 5.9 millimeters.

INDUSTRIAL APPLICABILITY

Referring to the drawings generally, a valve actuation system according to the present disclosure is contemplated to provide for increased power density in an engine system based upon offsets in the arrangement of components in the respective valve actuation systems. In the case of the embodiment of FIG. 2, rotation of camshaft 30 will move rocker arms 72 and 80 to open and close intake valves and exhaust valves, while injector rocker arm 46 reciprocates to pressurize fuel for injection. Injector roller 44 will rotate in contact with cam lobe 32, with forces between the respective components transferred in a contact "patch" that will experience contact pressures per unit area that are based on the width of contact. In the case of the embodiment of FIG. 7, operation will be generally analogous.

In certain earlier designs, where no offset based on rocker arm or valve lifter configuration was provided it was observed that the contact width could not be made large enough to distribute contact pressures in a manner that avoids unduly wearing the injector roller, the cam lobe, or both. While the present disclosure presents valve lifter configuration and rocker arm configuration as separate solutions, it should be appreciated that these embodiments could be combined with some of the offset provided by one or more valve lifters and some of the offset provided by one or more rocker arms. In still other instances, rather than valve lifters or rocker arms providing the desired offset enabling a sufficient injector roller width, pushrods in a valve actuation system could be canted to an axis of reciprocation of the valve lifters. In other words, embodiments are contemplated where at least one of a rocker arm center plane, or a lifter roller center plane is spaced an offset distance from a pushrod axis, in a direction parallel to the camshaft axis, without asymmetric features of a valve lifter or a rocker arm at all, and any misalignment from the canted arrangement of the pushrods simply being tolerated or compensated for in other ways.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A valve actuation system for an engine comprising:

a camshaft including a plurality of cam lobes and being rotatable about a camshaft axis;

an injector actuation linkage including an injector lifter having an injector roller in contact with a first one of the plurality of cam lobes;

a valve actuation linkage including a valve lifter defining a reciprocation axis, a pushrod seat centered on the reciprocation axis, and a lifter roller in contact with a second one of the plurality of cam lobes adjacent to the first one of the plurality of cam lobes;

the valve actuation linkage further including a valve rocker arm structured to couple with an engine valve, and a valve pushrod coupled between the valve lifter and the valve rocker arm and in contact with the pushrod seat;

the valve rocker arm defining a pivot axis and a rocker arm center plane extending through a center point of the pivot axis;

the lifter roller defining a rotation axis and a lifter roller center plane extending through a center point of the rotation axis;

the valve pushrod defining a pushrod axis extending through the valve pushrod, the valve lifter, and the valve rocker arm; and at least one of the rocker arm center plane or the lifter roller center plane is spaced an offset distance from the pushrod axis, within the respective rocker arm or valve lifter, in a direction parallel to the camshaft axis.

2. The system of claim 1 wherein:

the at least one of the rocker arm center plane or the lifter roller center plane is spaced the offset distance in an inboard direction or an outboard direction, respectively; and the injector roller defines a roller width, and the roller width exceeds the offset distance by a factor greater than ten.

3. The system of claim 2 further comprising a second valve actuation linkage that is a mirror image of the first valve actuation linkage and positioned opposite to the first valve actuation linkage relative to the injector actuation linkage.

4. The system of claim 1 wherein the rocker arm center plane is spaced the offset distance from the pushrod axis in an inboard direction.

5. The system of claim 4 wherein:

the valve lifter rocker arm includes a rod end, a valve end, an inboard lateral side and an outboard lateral side extending between the rod end and the valve end, and a pivot pin bore defining the pivot axis;

the valve lifter rocker arm further includes a screw bore formed in the rod end, and an adjustment screw within the screw bore and coupled with the pushrod; and the screw bore is offset relative to the rocker arm center plane, such that the adjustment screw is supported in the valve lifter rocker arm closer to the outboard lateral side than to the inboard lateral side.

6. The system of claim 1 wherein the lifter roller center plane is spaced the offset distance from the pushrod axis in an outboard direction.

7. The system of claim 6 wherein:

the valve lifter includes a fork having an inboard leg and an outboard leg, a pin received in the inboard leg and the outboard leg and supporting the lifter roller for rotation, and an oil passage extending through the outboard leg; and the valve lifter further includes an end section having a pushrod bore formed therein, and a middle section including a step having an inlet to the oil passage formed therein.

8. The system of claim 7 wherein the valve lifter further includes an inboard side surface that is planar and formed in part upon each of the middle section and the inboard leg, and an outboard side surface that is planar and formed on the outboard leg and stepped-out relative to the middle section.

9. A valve lifter for a valve actuation system in an engine comprising:

an elongate lifter body defining a longitudinal center axis and including an end section having a longitudinally extending pushrod bore formed therein, a pushrod seat centered on the longitudinal center axis within the longitudinally extending pushrod bore, a fork having an inboard leg and an outboard leg, and a middle section transitioning between the end section and the fork;

the inboard leg is spaced from the outboard leg to form a roller pocket, and the inboard leg and the outboard leg forming coaxial pin bores structured to receive a roller pin for supporting a roller in the roller pocket; and a center plane is defined between the inboard leg and the outboard leg and is spaced an offset distance from the longitudinal center axis.

10. The valve lifter of claim 9 wherein the middle section includes a necked-down section adjacent to the end section, and a transition section adjacent to the fork.

11. The valve lifter of claim 10 wherein the end section and the transition section define a common cylinder centered on the longitudinally extending center axis, and the outboard leg is located at least partially outside of the common cylinder.

12. The valve lifter of claim 11 wherein an oil passage extends through the valve lifter body from the middle section to the fork.

13. The valve lifter of claim 12 wherein the valve lifter body further includes a step formed between the necked-down section and the transition section, and the oil passage extends from an inlet port formed in the step to an outlet port.

14. The valve lifter of claim 13 wherein the outlet port is formed in the outboard leg.

15. The valve lifter of claim 9 wherein:

the elongate lifter body further includes an inboard side surface that is planar and stepped-in relative to the middle section, and an outboard side surface that is stepped-out relative to the middle section; and the coaxial pin bores include a first pin bore formed in the inboard leg and opening in the inboard side surface and a second pin bore formed in the outboard leg and opening in the outboard side surface.

16. The valve lifter of claim 15 further comprising a roller pin supported in the fork and a roller positioned upon the roller pin and defining a roller axis of rotation having a center point located in the center plane.

17. A rocker arm for a valve actuation system in an engine comprising:

a rocker arm body including a rod end, a valve end, a center section, and each of a first lateral side and a second lateral side extending between the rod end and the valve end;

the rocker arm body further having a pivot pin bore formed in the center section and extending horizontally through the rocker arm body between the first lateral side and the second lateral side and defining a pivot axis;

a rocker arm center plane extends through a center point of the pivot axis and is located equidistant between the first lateral side and the second lateral side;

the valve end further having a first bore formed therein and located symmetrically between the first lateral side and the second lateral side, such that the first bore is bisected by the rocker arm center plane; and the rod end further having a second bore formed therein and located asymmetrically between the first lateral side and the second lateral side, such that the second bore is offset relative to the rocker arm center plane and located relative closer to the first lateral side than to the second lateral side.

18. The rocker arm of claim 17 wherein the second bore includes an internally threaded screw bore.

19. The rocker arm of claim 17 wherein the second bore is intersected by the rocker arm center plane, and defines a center axis that is spaced an offset distance from the rocker arm center plane.

20. The rocker arm of claim 19 wherein the offset distance is between 2.5 millimeters and 3.5 millimeters.

* * * * *